United States Patent [19]

Chang

[11] Patent Number: 5,024,681

[45] Date of Patent: Jun. 18, 1991

[54] COMPACT HYBRID PARTICULATE COLLECTOR

[75] Inventor: Ramsay Chang, Los Altos, Calif.

[73] Assignee: Electric Power Research Institute, Palo Alto, Calif.

[21] Appl. No.: 451,517

[22] Filed: Dec. 15, 1989

[51] Int. Cl.[5] ..... B03C 3/00

[52] U.S. Cl. ..... 55/6; 55/96; 55/97; 55/124; 110/217

[58] Field of Search ..... 55/5, 6, 96, 97, 124, 55/126; 110/216, 217

[56] References Cited

U.S. PATENT DOCUMENTS

| | | | |
|---|---|---|---|
| 1,853,393 | 4/1932 | Anderson | 55/6 |
| 2,792,074 | 5/1957 | Schilb et al. | 55/341.1 |
| 3,395,512 | 8/1968 | Finney et al. | 55/97 |
| 3,745,748 | 7/1973 | Goldfield et al. | 55/97 |
| 3,915,676 | 10/1975 | Reed et al. | 55/112 |
| 4,147,522 | 4/1979 | Gonas et al. | 55/6 |
| 4,354,858 | 10/1982 | Kumar et al. | 55/6 |
| 4,357,151 | 11/1982 | Helfritch et al. | 55/6 |
| 4,411,674 | 10/1983 | Forgac | 55/304 |
| 4,507,130 | 3/1985 | Roth | 55/96 |

FOREIGN PATENT DOCUMENTS

| | | | |
|---|---|---|---|
| 50560 | 3/1982 | Japan | 55/5 |
| 176909 | 7/1988 | Japan | 55/6 |

*Primary Examiner*—Bernard Nozick
*Attorney, Agent, or Firm*—Leonard Bloom

[57] ABSTRACT

A method for removing particulates from a gas is described incorporating an electrostatic precipitator and a barrier filter in series, i.e. baghouse, downstream of the electrostatic precipitator. The series arrangement enables the barrier filter to operate at significantly higher filtration velocities than normal 4.06–20.32 cm/s (8–40 ft/min) versus 0.76–2.54 cm/s (1.5–5 ft/min) and reduces the size of the barrier filter significantly. The invention overcomes the problem of the sensitivity of electrostatic precipitator particulate collection efficiency to variations in particulate and flue gas properties and the alternative of having to substitute the electrostatic precipitator with large barrier filters in which its use would be prohibited by cost and space considerations.

9 Claims, 2 Drawing Sheets

COMPACT HYBRID PARTICULATE COLLECTOR

BACKGROUND OF THE INVENTION

1. Field of the Invention

This invention relates to pollution control, namely filtering of particulate matter, more specifically, to a method for filtering flyash and other particulates from flue gas.

2. Description of the Prior Art

Currently, there are approximately 1200 coal-fired utility power plants representing 330,000 MWe of generating capacity that are equipped with electrostatic precipitators. Present precipitators typically remove 90–99.9% of the flyash in the flue gas. However, existing and pending regulations to control sulfur dioxide emissions from the flue gas require utilities to switch fuel types (such as from high to low sulfur coal), or add sulfur dioxide control upstream of the precipitators. Fuel switching and sulfur control upstream of the precipitators generally modify flyash properties, reduce precipitator collection efficiency, and increase stack particulate emissions. In addition, particulate emissions standards are getting increasingly stringent. Faced with these increasingly stringent environmental requirements, utilities are looking for low cost retrofits to upgrade the performance of their precipitators.

It is well known in the art how to build and use electrostatic precipitators. It is also known in the art how to build and use a barrier filter such as a baghouse. Further, it is known in the art how to charge particles and that charged particles may be collected in a barrier filter with lower pressure drop and emissions than uncharged particles collected for the same filtration velocity.

Electric power utility companies are looking for ways to upgrade their precipitators. One approach would be to replace the existing under-performing precipitator with a baghouse or barrier filter of conventional design which are generally accepted as an alternative to precipitators for collecting flyash from flue gas. Conventional designs can be categorized as low-ratio baghouses (reverse-gas, sonic-assisted reverse-gas, and shake-deflate) which generally operate at filtration velocities of 0.76 to 1.27 centimeters per second (1.5 to 2.5 ft/min), also defined as air-to-cloth ratio or volumetric flow rate of flue gas per unit of effective filter area (cubic feet of flue gas flow/min/square foot of filtering area), and high-ratio pulse-jet baghouses which generally operate at 1.52 to 2.54 centimeters per second (3 to 5 ft/min). Baghouses generally have very high collection efficiencies (greater than 99.9%) independent of flyash properties. However, because of their low filtration velocities, they are large, require significant space, are costly to build, and unattractive as replacements for existing precipitators. Reducing their size by increasing the filtration velocity across the filter bags will result in unacceptably high pressure drops and outlet particulate emissions. There is also potential for "blinding" the filter bags—a condition where particles are embedded deep within the filter and reduce flow drastically.

In U.S. Pat. No. 3,915,676 which issued on Oct. 28, 1975 to Reed et al., an electrostatic dust collector is disclosed where the dirty gas is moved through an electrostatic precipitator to remove most of the particulate matter. The gas stream then passes through a filter having a metal screen and dielectric material wherein an electric field is applied to the filter which permits a more porous material to be used in the filter. The filter is of formacious and dielectric material to collect the charged fine particles. The filter and precipitator are designed in a concentric tubular arrangement with the dirty gas passing from the center of the tubes outward.

In U.S. Pat. No. 4,147,522 which issued on Apr. 3, 1979 to Gonas et al., the dirty gas stream passes through a tubular precipitator and then directly into a filter tube in series with the precipitator tube. The particles are electrically charged and are deposited on the fabric filter which is of neutral potential with regard to the precipitator. The major portion of the particles are however deposited in the electrostatic precipitator. No electric field is applied to the fabric filter. Precipitator and filter tube are cleaned simultaneously by a short burst of air.

In U.S. Pat. No. 4,354,858 which issued on Oct. 19, 1982 to Kumar et al., electrically charged particles in a gas stream are filtered from the stream by a filter medium which includes a porous cake composed of electrically charged particulates previously drawn from the gas stream and collected on a foraminous support structure.

In U.S. Pat. No. 4,357,151, which issued on Nov. 2, 1982, to Helfritch et al., an apparatus is disclosed which first moves dirty gas through a corona discharge electrodes located in the spaces between mechanical filters of the cartridge type having a filter medium of foraminous dielectric material such as pleated paper. The zone of corona discharge in the dirty gas upstream of the filter results in greater particle collection efficiency and lower pressure drop in the mechanical filters.

In U.S. Pat. No. 4,411,674, which issued on Oct. 25, 1983, to Forgac, a cyclone separator is disclosed wherein a majority of the dust is removed from dirty air in a conventional fashion followed by a bag filter. The bottoms of the filter bags have open outlets for delivering dust into a bottom chamber. The particulates are continuously conducted out of the bag filter apparatus for recirculation back to the cyclone separator.

In all the above patents, the inventors are looking for ways to reduce pressure drop and emissions across a barrier filter by precharging or mechanical precollection of the particles in the gas stream.

SUMMARY OF THE INVENTION

In accordance with present invention, a method for removing particulates from a gas is described comprising the steps of first passing the gas and the particulates through a conventional electrostatic precipitator whereby 90–99% of said particulates is removed, second passing the remaining particulates and said gas exiting from said electrostatic precipitator to a barrier filter placed downstream of said electrostatic precipitator and in proximity of said electrostatic precipitator to receive charged particulates exiting from said electrostatic precipitator, and designing and operating said barrier filter at filtration velocities in the range from 4.06–20.32 centimeters per second (8–40 feet per minute) (also defined as air-to-cloth ratio or volumetric flow rate of flue gas per unit of effective filter area) which is significantly higher than under normal design conditions, wherein the reduced concentration and residual electrical charge of particulates leaving the electrostatic precipitator and the ability to periodically clean captured particulates from the electrostatic precipitator and barrier filter independently of each other enable the barrier filter to operate continuously at very high filtration velocities.

The invention further provides a method for retrofitting the filtering of flue gas from a combustion system firing a fuel that generates particulates (such as a fossil-fuel-fired electric utility power plant or a municipal solid-waste incinerator) or heating a furnace where particulates are entrained (such as an iron or steel making furnace) having an electrostatic precipitator connected to a smoke stack, comprising the steps of inserting a compact barrier filter downstream of said electrostatic precipitator and position in close proximity to the electrostatic precipitator to receive charged particulates exhausting from said electrostatic precipitator and designing the barrier filter to operate at a filtration velocity of flue gas through the barrier filter in the range from 4.06–20.32 centimeters per second (8–40 feet per minute) (also defined as air-to-cloth ratio or volumetric flow rate of flue gas per unit of effective filter area), which is significantly higher than under normal design conditions, wherein the reduced concentration and residual electrical charge of particulates leaving the electrostatic precipitator and the ability to periodically clean captured particulates from the electrostatic precipitator and barrier filter independently of each other enable the barrier filter to operate continuously at very high filtration velocities.

DESCRIPTION OF THE PREFERRED EMBODIMENT

Figure 1:
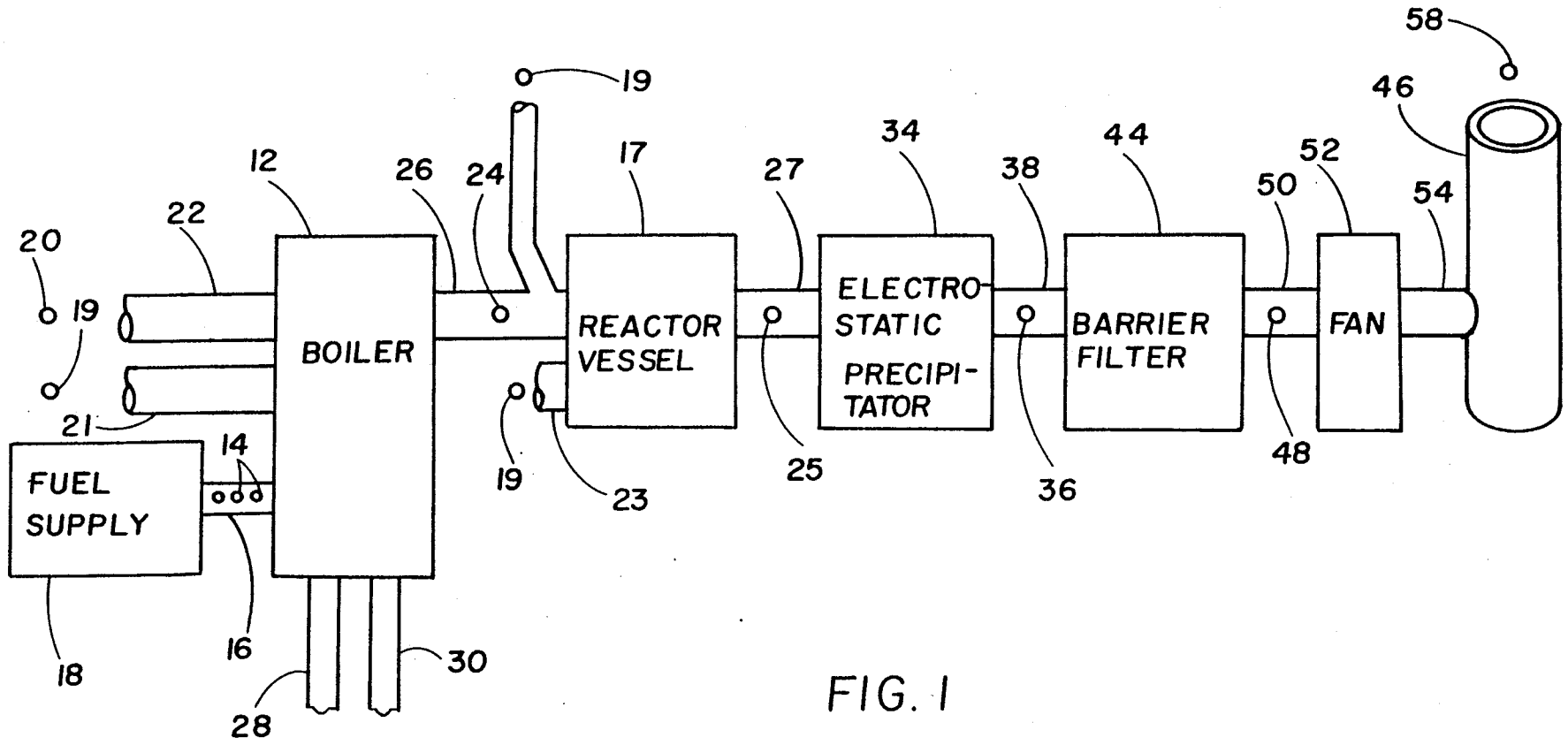
FIG. 1 is a block diagram of the treatment of flue gas from a fossil-fuel-fired boiler.

Referring now to the drawing, FIG. 1 shows a block diagram of a flue gas treatment system 10 for the treatment of flue gas exiting the boiler 12, such as that from a utility fossil-fuel-fired power plant although it is recognized that the invention applies equally well to any process that requires gas stream particulate control. Fuel supply 18 may be, for example, coal, oil, refuse derived fuel (RDF) or municipal solid waste (MSW). Boiler 12 also receives air 20 over inlet duct 22. Boiler 12 functions to combust the fuel 14 with air 20 to form flue gas 24 which exits boiler 12 by means of outlet duct 26. Boiler 12 also has a water inlet pipe 28 and a steam outlet pipe 30 for removing heat in the form of steam from boiler 12 generated by the combustion of fuel 14 with air 20.

Flue gas 24 is comprised of components of air and the products of combustion in gaseous form which include: water vapor, carbon dioxide, halides, volatile organic compounds, trace metal vapors, and sulfur and nitrogen oxides and the components of air such as oxygen and nitrogen. Flue gas 24 also contains particulates comprising unburned and partially combusted fuel which includes: inorganic oxides of the fuel, known as fly ash, carbon particles, trace metals, and agglomorates. Flue gas 24 may also contain particulates generated by the addition of removal agents 19 for sulfur oxide and other gas phase contaminates such as halides and trace metal vapors which are added into boiler 12 by way of duct 21, into duct 26, or into reactor vessel 17 by way of duct 23 upstream of the precipitator 34. Ducts 21, 26 and 23 may also convey solid materials if required for the selected removal agents 19 for the respective duct. Examples of sulfur oxide and other gas phase contaminate removal agents 19 include calcium carbonates, oxides and hydroxides, and sodium carbonates and bicarbonates. The particles or particulates in flue gas 24 can vary considerably in size, shape, concentration and chemical composition.

Flue gas 24 passes through duct 26 through reactor vessel 17 and through duct 27 as flue gas 25 to an inlet of electrostatic precipitator 34 which functions to charge and collect particles on electrodes within the electrostatic precipitator 34. Reactor vessel 17 may facilitate the chemical reaction of removal agents 19 with flue gas 24 to provided treated flue gas 25. Electrostatic precipitator 34 may remove, for example, from 90–99.9% of the particles and/or particulates in flue gas 24. The residual particles or particulates and all gas in flue gas 24 exit electrostatic precipitator 34 as treated flue gas 36 entering outlet duct 38. Treated flue gas 36 has roughly from 0.1–10% of the particulates or particles contained in the original flue gas 24 and also contain a certain amount of electronic charge which was transferred to it from the electrostatic precipitator 34. These particles were not collected within the electrostatic precipitator but exited outlet duct 38 to the inlet of barrier filter 44.

Barrier filter 44 is placed very close to electrostatic precipitator 34 so as to receive treated flue gas 36 and in particular to receive charged particles or particulates previously charged in electrostatic precipitator 34. Outlet duct 38 may also be electrically insulated to prevent the charged particles in the flue gas from discharging before collection in the barrier filter.

Figure 2:
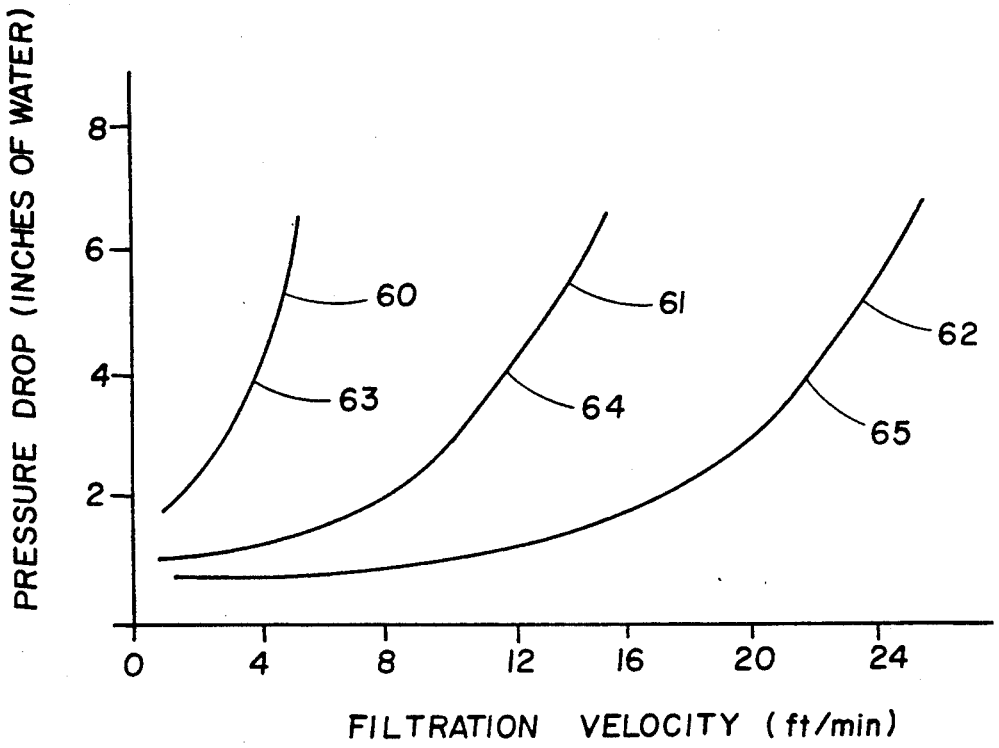
FIGS. 2 and 3 are hypothetical curves depicting the effect of flue gas particle concentration and particle electrical charge on the pressure drop and particle penetration across a barrier filter.

The particle concentration in the flue gas 36 entering the barrier filter 44 is reduced significantly by the precipitator 34 and contains residual electrical charge imparted by the precipitator 34. A hypothetical situation which describes the effect of low particle concentrations and the charging of particles on barrier filter pressure drop is shown in FIG. 2. Curve 60 in FIG. 2 shows the pressure drop across a barrier filter filtering particles from flue gas directly from boiler 12 in FIG. 1 without prefiltering by an electrostatic precipitator 34. Curve 61 shows what would happen when a significant portion of the particles in the flue gas is removed by an electrostatic precipitator 34 before entering the barrier filter 44, and assuming that the particles entering the barrier filter 44 has no electrical charge. Curve 62 shows what would happen to the pressure drop depicted by curve 61 if a residual electrical charge is carried by the particles exiting the electrostatic precipitator 34 and entering the barrier filter 44. It can be seen that for the same pressure drop across the barrier filter, indicated by points 63, 64, and 65 on curves 60–62 respectively, in FIG. 2, the condition represented by curve 62 allows significantly higher filtration velocity (also defined as air-to-cloth ratio or volumetric flow rate of flue gas per unit of effective filter area) than the other conditions represented by curves 60 and 61. A barrier filter downstream of an electrostatic precipitator is shown here to be capable of operation at a filtration velocity of 11.18 centimeters per second (22 ft/min) versus 2.03 centimeters per second (4 ft/min) for a barrier filter filtering flue gas without precleaning by an electrostatic precipitator.

Figure 3:
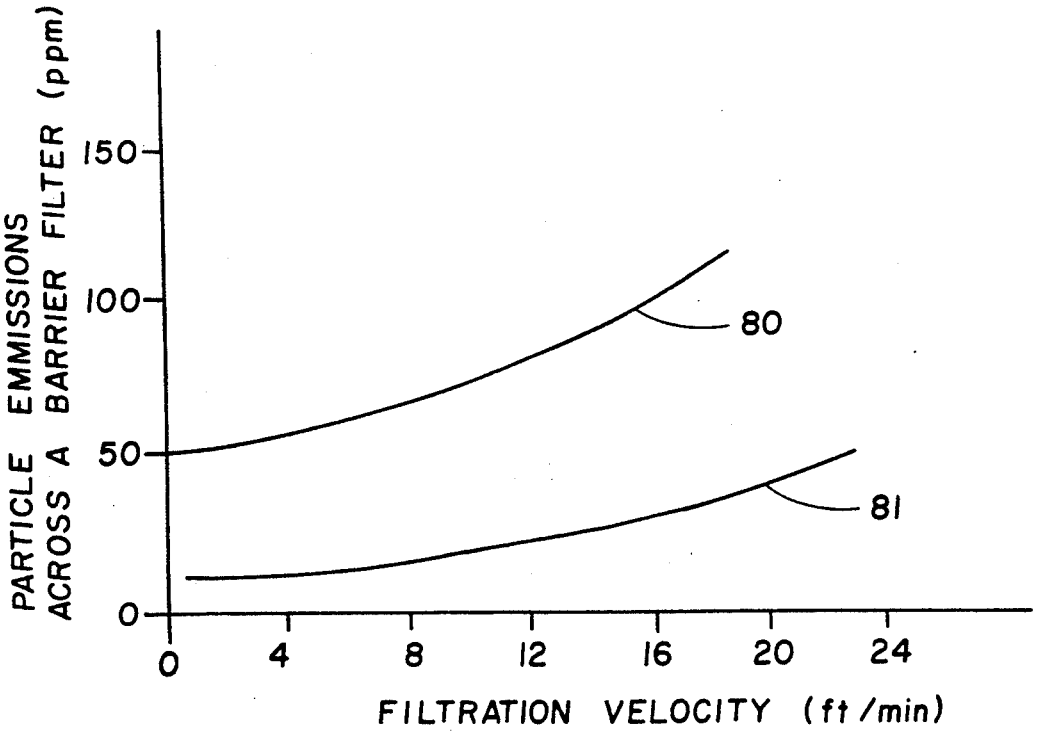

FIG. 3 is a hypothetical situation showing the effect of particle charging and filtration velocity on the particle penetration across a barrier filter. The particle penetration across a barrier filter increases as the filtration velocity increases as shown by curve 80 but is enhanced significantly by charging the particles as shown by curve 81. Thus, the charged particles exiting the electrostatic precipitator and entering the barrier filter could be filtered at high filtration velocities without increasing emissions across the barrier filter.

Because of the low particle loading and the electrical charge on the particles, barrier filter 44 can be adjusted in size to filter flue gas 36 at filtration velocities (also called air-to-cloth ratio) in the range from 4.06–20.32 centimeters per second, (8–40 feet per minute).

Examples of a barrier filter 44 are baghouses which may be of the pulse-jet type, reverse flow, or shake-deflate type for periodically removing the dust cake accumulated on the surface of the bag filter. Since the electrostatic precipitator 34 and the barrier filter 44 are separate devices, each can be cleaned independently of the other. By operating the barrier filter 44 with a higher face velocities of 4.06–20.32 centimeters per second (8–40 feet per minute) the size of the barrier filter with respect to conventional barrier filters is greatly reduced, allowing it to be retrofitted into existing boiler systems between the electrostatic precipitator and smoke stack 46 at substantial capital and installation cost savings and requiring very little real estate for its installation.

Flue gas 48 exiting barrier filter 44 passes over outlet duct 50 through fan 52 and duct 54 to the inlet of smoke stack 46. Flue gas 48 exits smoke stack 46 as gas 58 which mixes with the ambient air or atmosphere.

Fan 52 functions to overcome the additional pressure drop required to draw flue gas 48 across the barrier filter 44 to maintain a face velocity in the range from 4.06–20.32 centimeters per second (8–40 feet per minute) across barrier filter 44. Fan 52 also functions to draw flue gases 36 and 24 from electrostatic precipitator 34 and boiler 12 respectively. Fan 52 also functions to move flue gas 48 through duct 54 and out of smoke stack 46 as flue gas 58.

A method has been described for removing particulates from a gas comprising the steps of flowing flue gas through an electrostatic precipitator to remove 90–99% of the particulates, flowing the flue gas exiting the electrostatic precipitator through a barrier filter placed downstream of the electrostatic precipitator to receive charged particles and particulates which are collected on the barrier filter, adjusting the size of the barrier filter to operate at a face velocity in the range from 4.06–20.32 centimeters per second (8–40 feet per minute) wherein the reduced concentration and residual electrical charge of the particulates leaving the electrostatic precipitator and the ability to periodically cleans captured particulates from the electrostatic precipitator and barrier filter independently of each other enable the barrier filter to operate at very high filtration velocities continuously without adversely affecting filter pressure drop or emissions.

Further, a method for retrofitting the treatment or filtering of particulates in flue gas from a combustion source having an electrostatic precipitator connected to a smoke stack by way of a duct is described comprising the steps of inserting a barrier filter downstream of the electrostatic precipitator in close proximity of the electrostatic precipitator to receive charged particulates exhausting from the electrostatic precipitator and adjusting the size of the barrier filter to maintain a face velocity of flue gas through the barrier filter in the range from 4.06–20.32 centimeters per second (8–40 feet per minute) which is significantly higher than under normal design conditions, wherein the reduced concentration and residual electrical charge of particulates leaving the electrostatic precipitator and the ability to periodically clean captured particulates from the electrostatic precipitator and barrier filter independently of each other enable the barrier filter to operate continuously at very high filtration velocities.

What is claimed is:

1. A method for removing particulates from flue gas comprising the steps of:

flowing said flue gas through an electrostatic precipitator for removing 90–99% of said particulates, and for imparting a residual electric charge on remaining particulates exhausted from said electrostatic precipitator in said flue gas;

maintaining said residual electric charge on the remaining particulates while flowing said flue gas through a barrier filter placed downstream of said electrostatic precipitator at a high filtration velocity in the range of from 4.06–20.32 centimeters per second (8–40 feet per minute), said barrier filter collecting the charged particulates exhausted from said electrostatic precipitator in said flue gas before said residual electric charge substantially dissipates.

2. The method of claim 1, further including the step of cleaning said barrier filter of particulates at times said pressure drop across said barrier filter exceeds 2.54 to 30.48 centimters of water (1 to 12 inches of water).

3. The method of claim 1, wherein said step of placing a barrier filter includes the step of placing a baghouse.

4. The method of claim 1, further including the step of inserting a fan coupled to said barrier filter for maintaining said face velocity.

5. A method for retrofit filtering of particulates in a flue gas from a combustion source having an existing electrostatic precipitator connected to a smoke stack, comprising the steps of:

connecting an electrically insulated duct to said electrostatic precipitator;

inserting a barrier filter downstream of said electrostatic precipitator and said duct for collecting particulates exhausted from said electrostatic precipitator in said flue gas, said barrier filter being positioned in close proximity to said electrostatic precipitator and said duct for receiving charged particulates exhausting from said electrostatic precipitator while a residual electric charge imparted on said particulates by said electrostatic precipitator is maintained; and maintaining a filtration velocity of flue gas through said barrier filter in the range of from 4.06–20.32 centimeters per second (8–40 feet per minute).

6. The method of claim 5, further including the step of cleaning particulates off said barrier filter at times said pressure drop across said barrier filter exceeds a predetermined value in the range from 2.54–30.48 centimeters of water (1–12 inches of water).

7. The method of claim 5, wherein said step of inserting a barrier filter includes the step of inserting a baghouse.

8. The method of claim 5, further including the step of inserting a fan in the path of said flue gas for maintaining said filtration velocity through said barrier filter.

9. The method of claim 5, wherein said combustion source is a fossil-fuel-fired boiler.

* * * * *